US010092073B2

(12) United States Patent
Wagoner

(10) Patent No.: US 10,092,073 B2
(45) Date of Patent: Oct. 9, 2018

(54) SPLIT WING COLLAPSIBLE LUGGAGE

(71) Applicant: DAKINE, INC., Hood River, OR (US)

(72) Inventor: Graeme Wagoner, Portland, OR (US)

(73) Assignee: Dakine, Inc., Hood River, OR (US)

( * ) Notice: Subject to any disclaimer, the term of this patent is extended or adjusted under 35 U.S.C. 154(b) by 463 days.

(21) Appl. No.: 14/708,681

(22) Filed: May 11, 2015

(65) Prior Publication Data

US 2016/0331092 A1 Nov. 17, 2016

(51) Int. Cl.
*B62B 3/00* (2006.01)
*A45C 7/00* (2006.01)

(52) U.S. Cl.
CPC ..... *A45C 7/0036* (2013.01)

(58) Field of Classification Search
CPC ..... A45C 7/0036; A45C 7/0077; A45C 3/00; A45C 5/14; A45C 7/0095
USPC ..... 190/107, 100, 103, 105, 122, 127, 18 A, 190/22; 220/9.2; 206/279, 287.1, 289, 206/315.1
See application file for complete search history.

(56) References Cited

U.S. PATENT DOCUMENTS 2,806,563 A 9/1957 Einhorn
3,647,035 A 3/1972 Honig
5,103,945 A 4/1992 Kaneko
2002/0185350 A1* 12/2002 Chang ..... A45C 5/02 190/105
2005/0067244 A1* 3/2005 Smith ..... A45C 7/0022 190/103
2005/0224304 A1* 10/2005 Bhavnani ..... A45C 7/0077 190/107
2006/0272913 A1* 12/2006 Chen ..... A45C 7/0036 190/127
2007/0151820 A1* 7/2007 Lin ..... A45C 7/0022 190/103
2010/0300825 A1* 12/2010 Nordstrom ..... A45C 7/0036 190/107
2014/0246967 A1* 9/2014 Glenn, Jr. ..... A47B 43/00 312/258
2014/0299429 A1* 10/2014 Tseng ..... A45C 5/02 190/103

(Continued)

OTHER PUBLICATIONS

Biaggi, Luggage that Folds, retrieved from the Internet at http://www.biaggi.com on Nov. 4, 2015, 5 pages as printed.

(Continued)

*Primary Examiner* — Fenn C Mathew
*Assistant Examiner* — Cynthia Collado
(74) *Attorney, Agent, or Firm* — Foley & Lardner LLP

(57) ABSTRACT

An article of collapsible luggage includes a front surface, a plurality of front perimeter walls forming a closed perimeter around the front surface, and a split wing assembly having a left wing and a right wing. Both wings are pivotally attached the front perimeter walls and configured to rotate between a reinforcing position and a collapsing position. In the reinforcing position, the wings reinforce corners of the collapsible luggage and maintain the plurality of front perimeter walls substantially perpendicular to the front surface. In the collapsing position, the wings do not reinforce the corners of the collapsible luggage, thereby allowing the plurality of front perimeter walls to collapse into a substantially coplanar arrangement with the front surface.

16 Claims, 13 Drawing Sheets

(56) References Cited

U.S. PATENT DOCUMENTS

| | | | | |
|---|---|---|---|---|
| 2015/0041272 | A1* | 2/2015 | Shyr | A45C 7/0036 190/18 A |
| 2016/0121916 | A1* | 5/2016 | Kassab Arabo | B62B 3/025 280/37 |

OTHER PUBLICATIONS

Lipault Paris 28" Foldable Wheeled Upright, retrieved from the Internet at http://www.handbags.com/lipault/28-foldable-2-wheeled-upright/203726 on Nov. 4, 2015, 2 pages as printed.

Lowell, J., Eight Perfect Suitcases You'll Want to Use Forever, Road Warrior M Series Upright, Smarter Travel, May 4, 2013, retrieved from the Internet at http://www.smartertravel.com/photo-galleries/editorial/eight-perfect-suitcases-youll-want-to-use-forever.html?id=434&photo=47722 on Oct. 26, 2015, 2 pages as printed.

Luggage Factory, Road Warrior M Series 21in Expandable Carry On Upright (7803761) product description, as available online on Aug. 26, 2013 at http://www.luggagefactory.com/cgi-bin/shopper.cgi?preadd=action&key=S659-7803761, retrieved from the Internet archives on Nov. 3, 2015, 2 pages as printed.

* cited by examiner

SPLIT WING COLLAPSIBLE LUGGAGE

BACKGROUND

The present invention relates generally to luggage and other types of containers for personal belongings. The present invention relates more particularly to luggage capable of collapsing to occupy a smaller volume.

Luggage is typically used to contain personal belongings while traveling. It is often desirable for luggage to be rigid to protect the belongings stored therein, especially when the luggage is handled by persons other than the luggage owner (e.g., at an airport). However, most luggage is only used during travel and is otherwise stored at the user's residence.

Some luggage is quite voluminous and requires a significant amount of storage space. The amount of space occupied by luggage can also be an issue when transporting luggage from a manufacturer to a distributor such as a retail store. For example, luggage deliveries are often inefficient since the luggage consists of mostly empty space. In a retail setting, the amount of space required to display luggage often forces retailers to display only a small portion of their luggage inventory while storing the majority of the luggage in a warehouse or other location that is inaccessible to a consumer.

For these and other reasons, it would be desirable to provide luggage that has sufficient structural rigidity sufficient to protect the belongings stored therein while the luggage is in use and which can collapse to occupy a lesser volume when the luggage is not in use.

SUMMARY

One implementation of the present disclosure is an article of collapsible luggage. The collapsible luggage includes a front surface having a left side edge, a right side edge, and a bottom edge connecting the left side edge to the right side edge. The collapsible luggage further includes a left side surface connected to the front surface along the left side edge and a right side surface connected to the front surface along the right side edge. The collapsible luggage further includes a bottom surface connected to the front surface along the bottom edge and connecting the left side surface to the right side surface. An intersection of the bottom surface and the left side surface defines a left corner and an intersection of the bottom surface and the right side surface defines a right corner.

The collapsible luggage further includes a split wing assembly having a left wing and a right wing. Both wings are pivotally attached to the bottom surface and configured to rotate about an axis substantially perpendicular to the bottom surface between a reinforcing position and a collapsing position. In the reinforcing position, the left wing reinforces the left corner and the right wing reinforces the right corner. The corner reinforcements provided by the wings maintain the bottom surface substantially perpendicular to the left side surface, the right side surface, and the front surface. In the collapsing position, the wings do not reinforce the corners, thereby allowing the left side surface, the right side surface, and the bottom surface to collapse into a substantially coplanar arrangement with the front surface.

In some embodiments, the bottom surface is substantially rigid and configured to rotate about the bottom edge to collapse into the substantially coplanar arrangement with the front surface when the wings are in the collapsing position.

In some embodiments, each of the wings is a substantially rectangular sheet having a long edge and a short edge perpendicular to the long edge. The long edge of each wing may be parallel to the front surface when the wings are in the reinforcing position. The short edge of each wing may be parallel to the front surface when the wings are in the collapsing position.

In some embodiments, the left wing and the right wing are pivotally attached to the bottom surface by a fastener (e.g., a rivet, a pin, a bolt, etc.) which passes through both wings and the bottom surface. Both wings may rotate about the same axis coaxial with the fastener. In some embodiments, the fastener passes through a point in each wing approximately equidistant from both the long edge and the short edge. In some embodiments, the fastener passes through a point in each wing that is offset relative to a center of the wing (e.g., offset relative to a center line that is equidistant from opposing long edges and/or short edges). The position of the fastener may allow each wing to rotate in only one direction from the collapsing position to the reinforcing position.

In some embodiments, the left wing and the right wing rotate in opposite directions when moving from the collapsing position into the reinforcing position. Each wing may include a marking indicating the direction that the wing rotates when moving from the collapsing position into the reinforcing position. In some embodiments, the direction of rotation of each wing is indicated by instructions provided with the collapsible luggage (e.g., affixed inside the collapsible luggage, printed in a user guide that accompanies the collapsible luggage, etc.) rather than by markings on the wings.

In some embodiments, the left wing and the right wing are configured to bend. In the collapsing position, both wings may be planar sheets substantially parallel to the bottom surface. In the reinforcing position, both wings may be bent by approximately 90° such that a first portion of each wing is substantially parallel to the bottom surface and a second portion of each wing is substantially parallel to the left and right side surfaces.

In some embodiments, the left wing is configured to bend around the left corner when rotated into the reinforcing position such that a first portion of the left wing is substantially parallel with the bottom surface and a second portion of the left wing is substantially parallel with the left surface. The right wing may be configured to bend around the right corner when rotated into the reinforcing position such that a first portion of the right wing is substantially parallel with the bottom surface and a second portion of the right wing is substantially parallel with the right surface.

In some embodiments, the collapsible luggage includes a left pocket attached to the left side surface and a right pocket attached to the right side surface. The left pocket may be configured to receive a portion of the left wing when the left wing is rotated into the reinforcing position. The right pocket may be configured to receive a portion of the right wing when the right wing is rotated into the reinforcing position.

In some embodiments, the collapsible luggage includes a left fastener configured to secure the left wing in the reinforcing position and a right fastener configured to secure the right wing in the reinforcing position. In some embodiments, the left fastener and the right fastener are hook-and-loop fasteners. The fasteners may include a hook-and-loop fastener patch affixed to an inward-facing surface of each wing and a hook-and-loop fastener strap attached to each of the left surface and the right surface. In other embodiments, the fasteners may be any of a variety of fasteners (e.g., clips, clasps, snaps, buckles, locks, etc.).

Another implementation of the present disclosure is an article of collapsible luggage. The collapsible luggage includes a rear section and a front section attached to the rear section. The rear section includes a rear surface, a plurality of rear perimeter walls forming a closed perimeter around the rear surface, and a plurality of fixed support members reinforcing corners of the rear section and maintaining the plurality of rear perimeter walls substantially perpendicular to the rear surface. The front section includes a front surface, a plurality of front perimeter walls forming a closed perimeter around the front surface, and a split wing assembly having a left wing and a right wing. Both wings are pivotally attached to the front perimeter walls and configured to rotate between a reinforcing position and a collapsing position. In the reinforcing position, the wings reinforce corners of the front section and maintain the plurality of front perimeter walls substantially perpendicular to the front surface. In the collapsing position, the wings do not reinforce the corners of the front section, thereby allowing the plurality of front perimeter walls to collapse into a substantially coplanar arrangement with the front surface.

In some embodiments, the front section is configured to fit within the rear section when the front perimeter walls collapse into the substantially coplanar arrangement with the front surface.

In some embodiments, the front perimeter walls include a bottom wall. The left wing and the right wing may be pivotally attached to the bottom wall by a fastener (e.g., a rivet, a pin, a bolt, etc.) which passes through both wings and the bottom wall. Both wings may rotate about a shared axis coaxial with the fastener.

In some embodiments, each of the wings is a substantially rectangular sheet having a long edge and a short edge perpendicular to the long edge. The fastener may pass through a point in each wing approximately equidistant from both the long edge and the short edge. In some embodiments, the fastener passes through a point in each wing that is offset relative to a center of the wing (e.g., offset relative to a center line that is equidistant from opposing long edges and/or short edges). The position of the fastener may allow each wing to rotate in only one direction from the collapsing position to the reinforcing position.

In some embodiments, the front perimeter walls include a bottom wall, a left side wall, and a right side wall. The left wing and the right wing may be configured to bend between the collapsing position and the reinforcing position. In the collapsing position, both wings may be planar sheets substantially parallel to the bottom wall. In the reinforcing position, both wings may be bent by approximately 90° such that a first portion of each wing is substantially parallel to the bottom wall and a second portion of each wing is substantially parallel to the left and right side walls.

In some embodiments, the left wing and the right wing rotate in opposite directions when moving from the collapsing position into the reinforcing position. Each wing may include a marking indicating the direction that the wing rotates when moving from the collapsing position into the reinforcing position.

In some embodiments, the collapsible luggage includes left pocket attached to the plurality of front perimeter walls. The left pocket may be configured to receive a portion of the left wing when the left wing is rotated into the reinforcing position. The collapsible luggage may further include a right pocket attached to the plurality of front perimeter walls. The right pocket may be configured to receive a portion of the right wing when the right wing is rotated into the reinforcing position.

In some embodiments, the collapsible luggage includes a left fastener configured to secure the left wing in the reinforcing position and a right fastener configured to secure the right wing in the reinforcing position.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Referring generally to the FIGURES, an article of collapsible luggage is shown, according to an exemplary embodiment. The collapsible luggage is configured to transform between an expanded state and a collapsed state. In the expanded state, the collapsible luggage can be used to contain personal belongings and is sufficiently rigid to provide structural support and protection for the belongings contained therein. In the collapsed state, the collapsible luggage has a reduced size (i.e., approximately half the size as the expanded state) and can be stored and/or transported in a space-efficient manner.

The collapsible luggage includes a front section and a rear section. The rear section includes a rear surface and a plurality of rear perimeter walls forming a closed perimeter around the rear surface. The front section includes a front surface a plurality of front perimeter walls forming a closed perimeter around the front surface. In some embodiments, the rear section is substantially rigid. For example, the rear section may include a plurality of fixed corner supports which reinforce the corners of the rear section. The fixed corner supports maintain the rear perimeter walls substantially perpendicular to the rear surface.

Advantageously, the front section includes a split wing assembly which enables the collapsible luggage to transform between the expanded state and the collapsed state. The split wing assembly includes a left wing and a right wing. Both wings are pivotally attached to a bottom surface of the front section and configured to rotate about an axis substantially perpendicular to the bottom surface. The wings rotate between a reinforcing position and a collapsing position. In the reinforcing position, the left wing reinforces a left corner of the front section and the right wing reinforces a right corner of the front section. The corner reinforcements provided by the split wing assembly maintain the front perimeter walls substantially perpendicular to the front surface increase the rigidity of the front section when the wings are in the reinforcing position. In the collapsing position, the wings do not reinforce the corners of the front section. Without the reinforcements provided by the split wing assembly, the front perimeter walls are allowed to collapse into a substantially coplanar arrangement with the front surface. In some embodiments, the front section is configured to fit within the rear section when the front section is collapsed. These and other features of the collapsible luggage are described in greater detail below.

Figure 1:
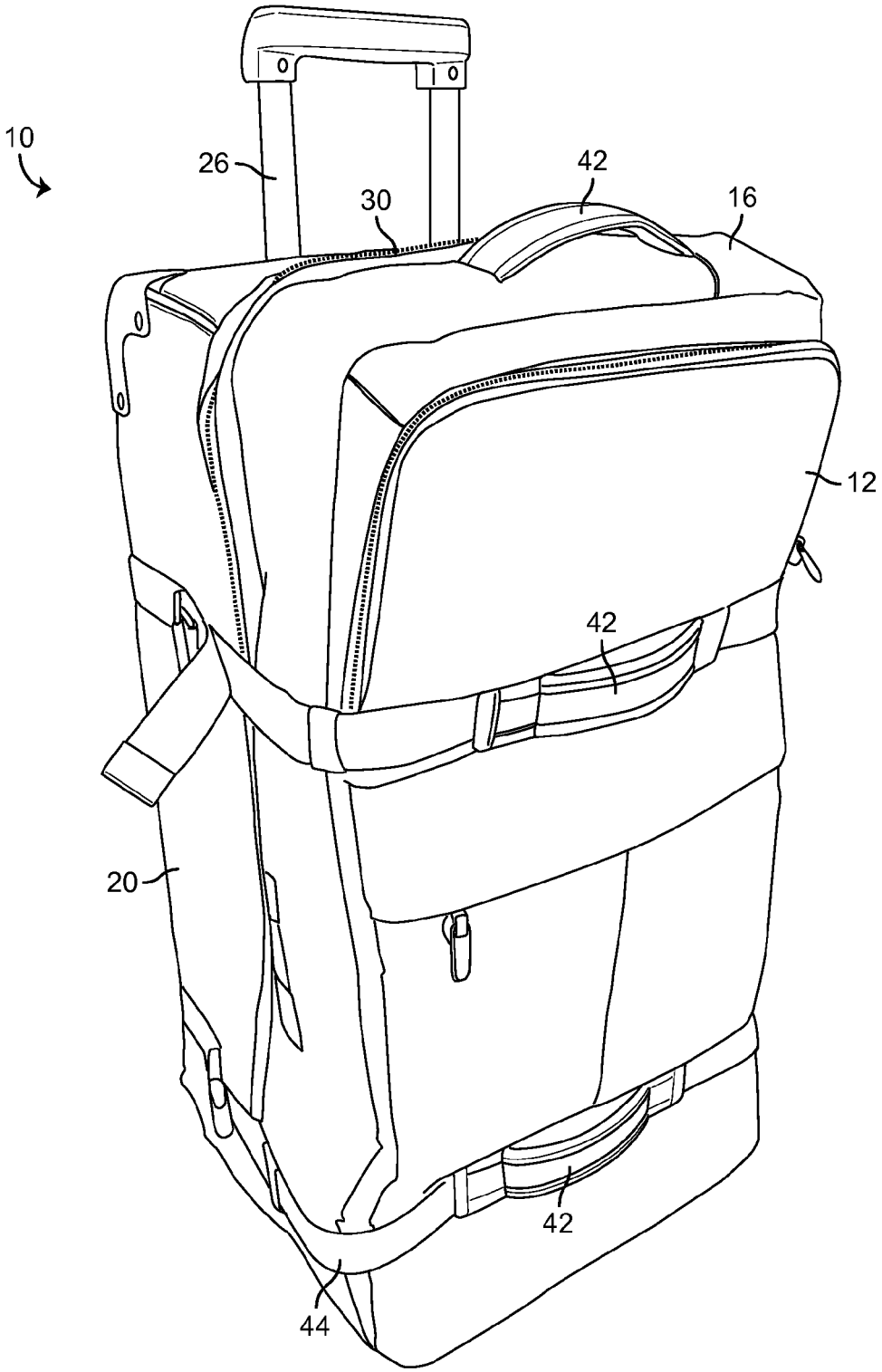
FIG. 1 is a drawing of an article of collapsible luggage configured to transform between an expanded state and a collapsed state in which a reduction in volume is achieved relative to the expanded state, according to an exemplary embodiment.
Figure 2A:
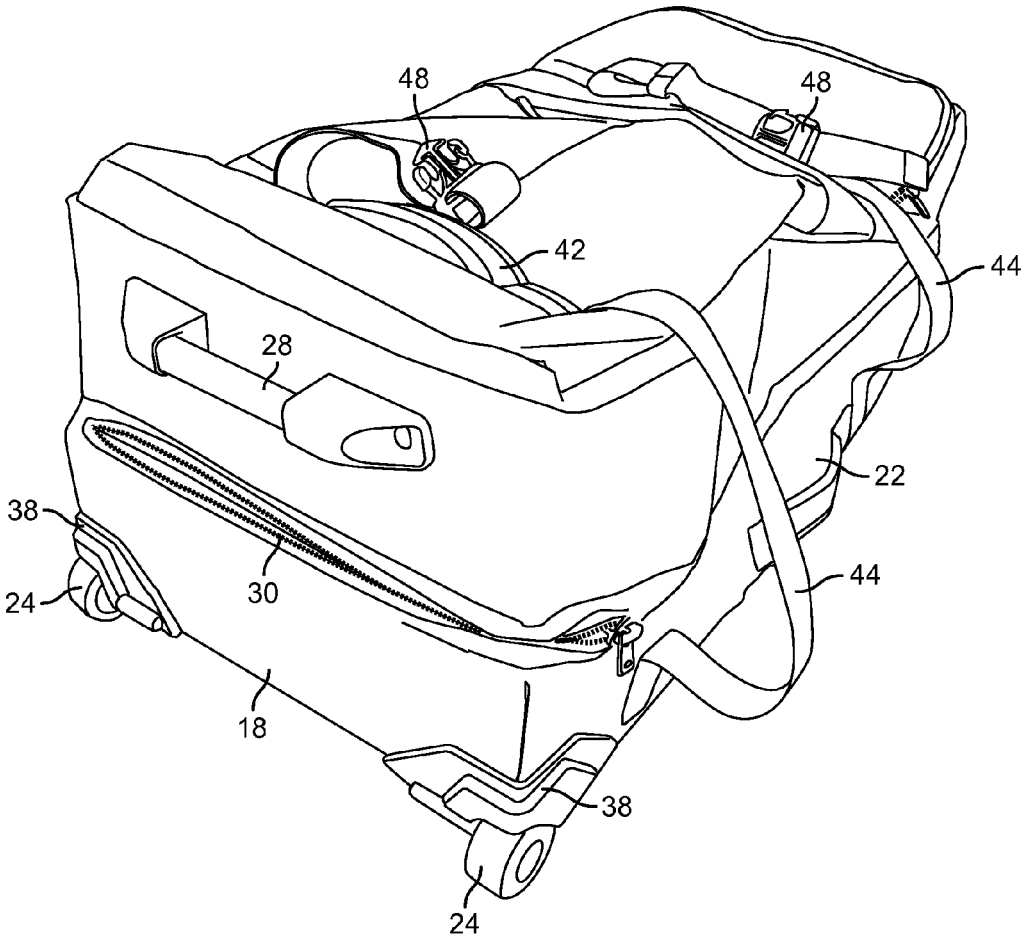
FIG. 2A is a drawing illustrating the collapsible luggage of FIG. 1 in a closed position and in the expanded state, according to an exemplary embodiment.
Figure 2B:
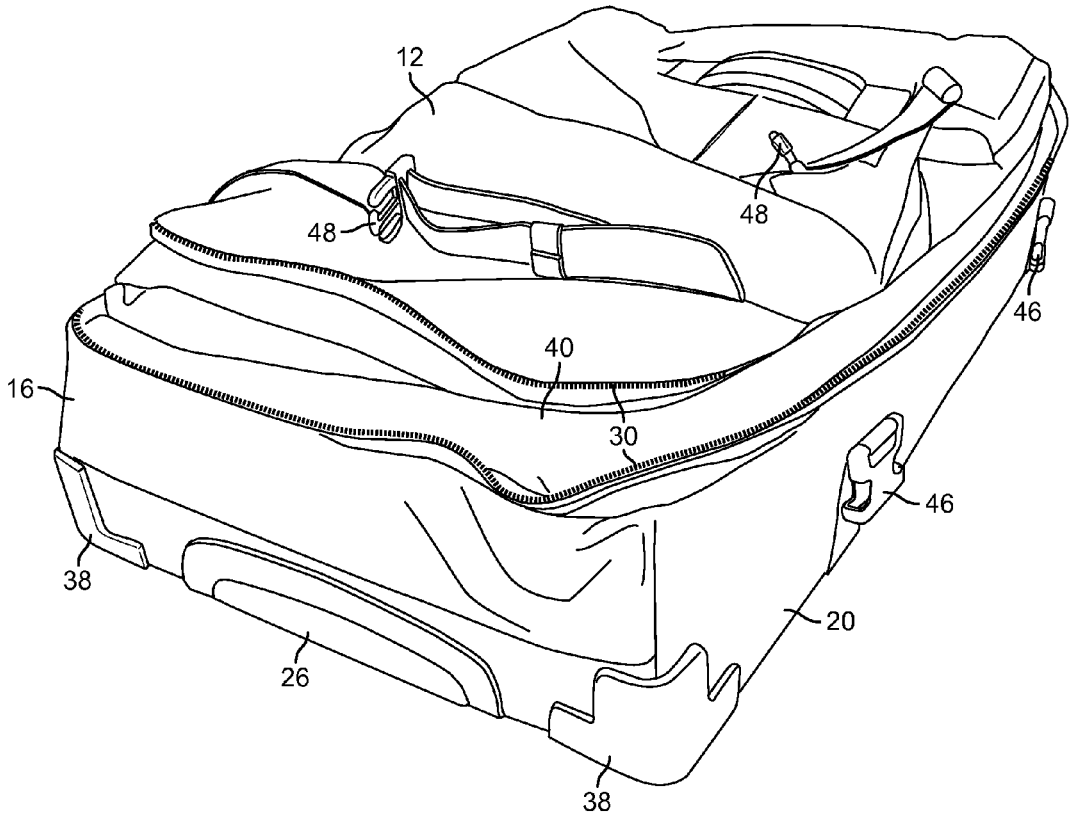
FIG. 2B is a drawing illustrating the collapsible luggage of FIG. 1 in the closed position and in a collapsed state, according to an exemplary embodiment.
Figure 3:
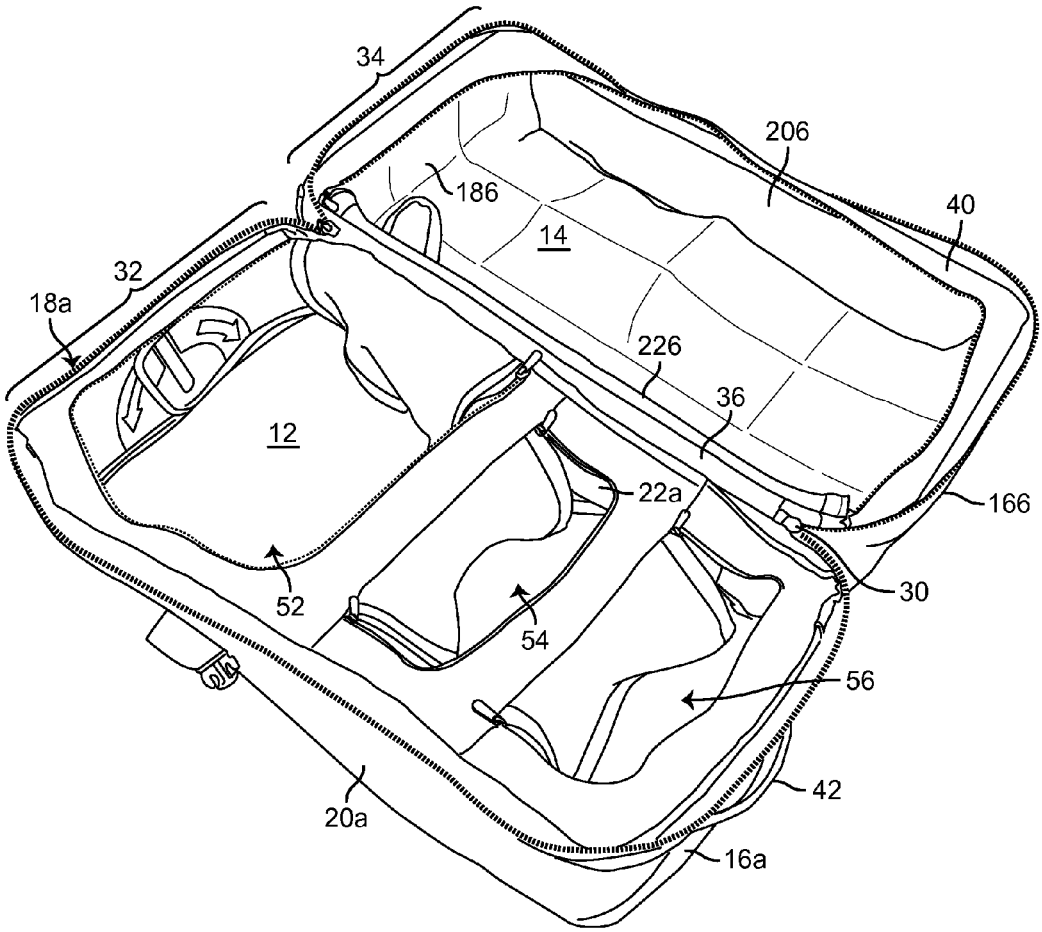
FIG. 3 is a drawing illustrating the collapsible luggage of FIG. 1 in an open position in the expanded state, according to an exemplary embodiment.

Referring now to FIGS. 1-3, an article of collapsible luggage 10 is shown, according to an exemplary embodiment. In brief overview, FIG. 1 shows collapsible luggage 10 in an upright position in the expanded state. FIGS. 2A-2B illustrate the reduction in volume achieved when collapsible luggage 10 is in the collapsed state (FIG. 2B) relative to when collapsible luggage 10 is in the expanded state (FIG. 2A). For example, collapsible luggage 10 may occupy approximately half the volume in the collapsed state. FIG. 3 shows collapsible luggage 10 in an open position in the expanded state.

Collapsible luggage 10 is shown as a substantially hexahedral container having a front surface 12, a rear surface 14, a top surface 16, a bottom surface 18, a left side surface 20, and a right side surface 22. In some embodiments, surfaces 12-22 are made of a durable textile material (e.g., nylon, polyester, polyurethane, Kevlar, etc.) and may be resistant to tearing, punctures, scratches, and/or other types of damage. One or more of surfaces 12-22 may be padded (e.g., with a layer of foam) to provide cushioning for the items within collapsible luggage 10. In some embodiments, one or more surfaces 12-22 may be substantially rigid without affecting collapsibility. For example, the surfaces of rear section 34 (shown in FIG. 3) may be made of a rigid or substantially rigid polymer (e.g. acrylonitrile butadiene styrene (ABS), polyethylene (PE), ethylene-vinyl acetate (EVA) foam, etc.), metal, or other rigid or substantially rigid material.

In some embodiments, collapsible luggage 10 includes wheels 24 and a telescoping handle 26. As shown in FIG. 2A, wheels 24 may be located along bottom surface 18 (e.g., an intersection of bottom surface 18 and rear surface 14 and/or at the corners of bottom surface 18). Telescoping handle 26 may be configured to move between an extended position in which telescoping handle 26 projects from top surface 16 (as shown in FIG. 1) and a retracted position in which telescoping handle 26 is substantially level with top surface 16 (as shown in FIG. 2A). Wheels 24 and telescoping handle 26 may facilitate transport of collapsible luggage 10. For example, collapsible luggage 10 may be tipped onto wheels 24 and pulled using telescoping handle 26. In some embodiments, wheels 24 project beyond bottom surface 18. Collapsible luggage 10 may include a support stand 28 attached to bottom surface 18. Support stand 28 may project beyond bottom surface 18 by the same amount as wheels 24 such that collapsible luggage 10 is substantially level when oriented with bottom surface 18 facing downward (as shown in FIG. 1).

Collapsible luggage 10 is shown to include a primary fastener 30 used to open and close collapsible luggage 10. In FIGS. 1-3, fastener 30 is shown as a zipper which runs along top surface 16, one of side surfaces 20-22, and bottom surface 18. However, fastener 30 may be any of a variety of fasteners (e.g., clips, clasps, buckles, locks, etc.) in various alternative embodiments. Fastener 30 joins a front section 32 of collapsible luggage 10 to a rear section 34 of collapsible luggage 10 and allows front section 32 to swing open relative to rear section 34. For example, front section 32 may rotate relative to rear section 34 about edge 36. As shown in FIG. 3, front section 32 may include front surface 12 and a plurality of front perimeter walls 16*a*, 18*a*, 20*a*, and 22*a*, which are frontal portions of top surface 16, bottom surface 18, left side surface 20, and right side surface 22, respectively. When collapsible luggage 10 is in the expanded state, perimeter walls 16*a*-22*a* are substantially perpendicular to front surface 12 and form a closed perimeter around front surface 12. However, when collapsible luggage 10 is in the collapsed state, perimeter walls 16*a*-22*a* may collapse into a substantially coplanar arrangement with front surface 12.

Rear section 34 may include rear surface 14 and a plurality of rear perimeter walls 16*b*, 18*b*, 20*b*, and 22*b*, which are rear portions of top surface 16, bottom surface 18, left side surface 20, and right side surface 22, respectively. In some embodiments, rear surface 14 and rear perimeter walls 16*b*-22*b* are substantially rigid. As shown in FIGS. 2A-2B, rear section 34 may include corner reinforcements 38. Corner reinforcements 38 may reinforce the corners of rear section 34 and maintain rear perimeter walls 16*b*-22*b* substantially perpendicular to rear surface 14. In some embodiments, rear section 34 is not collapsible, but rather is maintained in a fixed and/or substantially rigid position in both the collapsed and expanded states. In some embodiments, rear section 34 includes a lip 40. When collapsible luggage 10 is in the collapsed state, front section 32 may be tucked under lip 40 (as shown in FIG. 2B) such that front section 32 is securely held within rear section 34.

In various embodiments, collapsible luggage 10 may include any number of internal or external pockets, compartments, apertures, chambers, spaces, or other container-related features as may be desirable for storing, separating, and/or securing personal belongings or other items. For example, rear section 34 is shown to include one large internal compartment 50 and front section 32 is shown to include a plurality of smaller internal compartments 52, 54, and 56. Collapsible luggage 10 may also include any number of external pockets or compartments, which may be opened and closed via zippers, clips, or other fasteners. In some embodiments, collapsible luggage 10 includes one or more external handles 42 secured to one or more of surfaces 12-22 and configured to facilitate transport of collapsible luggage 10.

In some embodiments, collapsible luggage 10 includes one or more straps 44. Straps 44 may be configured to securely hold collapsible luggage 10 in the closed position shown in FIG. 1. Straps 44 may be secured at one end to an external surface of rear section 34 (e.g., side surface 22) as shown in FIG. 2A. Straps 44 may wrap around front section 32 (e.g., under handles 42) and engage fasteners 46 on the opposite side of rear section 34. In some embodiments, fasteners 46 are secured to an external surface of rear section 34 (e.g., side surface 20). Straps 44 are shown to include clips 48, which may be configured to engage and interlock with fasteners 46. In some embodiments, straps 44 have an adjustable length which allows straps 44 to tighten when collapsible luggage 10 is in the collapsed state to securely hold collapsible luggage 10 in the collapsed state.

Referring now to FIGS. 4A-8B, collapsible luggage 10 is shown to include a split wing assembly 60. Advantageously, split wing assembly 60 may enable collapsible luggage 10 to transform between the collapsed state and the expanded state. Split wing assembly 60 is shown to include a left wing 62 and a right wing 64. Wings 62-64 may be pivotally attached to bottom surface 18 and configured to rotate about an axis substantially perpendicular to bottom surface 18. In some embodiments, both of wings 62-64 are pivotally attached to bottom surface 18 by a fastener (e.g., a rivet, a pin, a bolt, etc.), shown in FIG. 4A as a rivet 66. Rivet 66 may pass through left wing 62, right wing 64, and bottom surface 18. In some embodiments, both wings 62-64 rotate about the same axis coaxial with rivet 66. Each of wings 62-64 is shown as a substantially rectangular sheet having a long edge 88 and a short edge 90 perpendicular to long edge 88. In some embodiments, rivet 66 passes through a point in each of wings 62-64 approximately equidistant from both long edge 88 and short edge 90. Wings 62-64 may be configured to rotate between a reinforcing position (shown in FIGS. 4A-4B) and a collapsing position (shown in FIGS. 8A-8B).

Figure 4A:
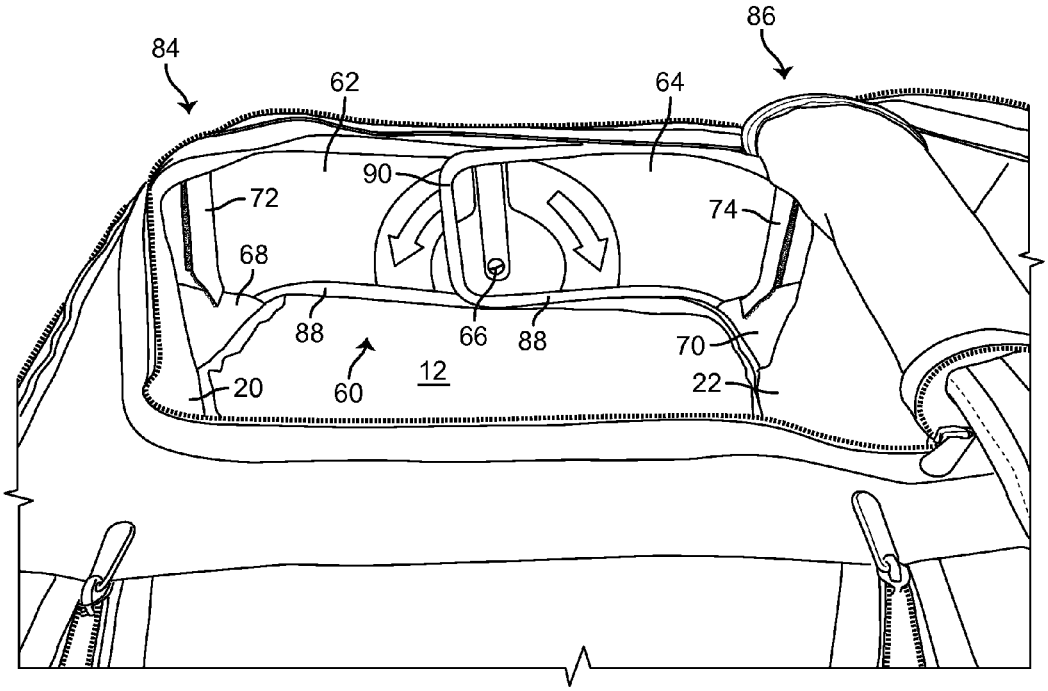
FIGS. 4A-4B are drawings illustrating a split wing assembly of the collapsible luggage of FIG. 1 in a reinforcing position in which the split wing assembly prevents the collapsible luggage from collapsing into the collapsed state, according to an exemplary embodiment.
Figure 4B:
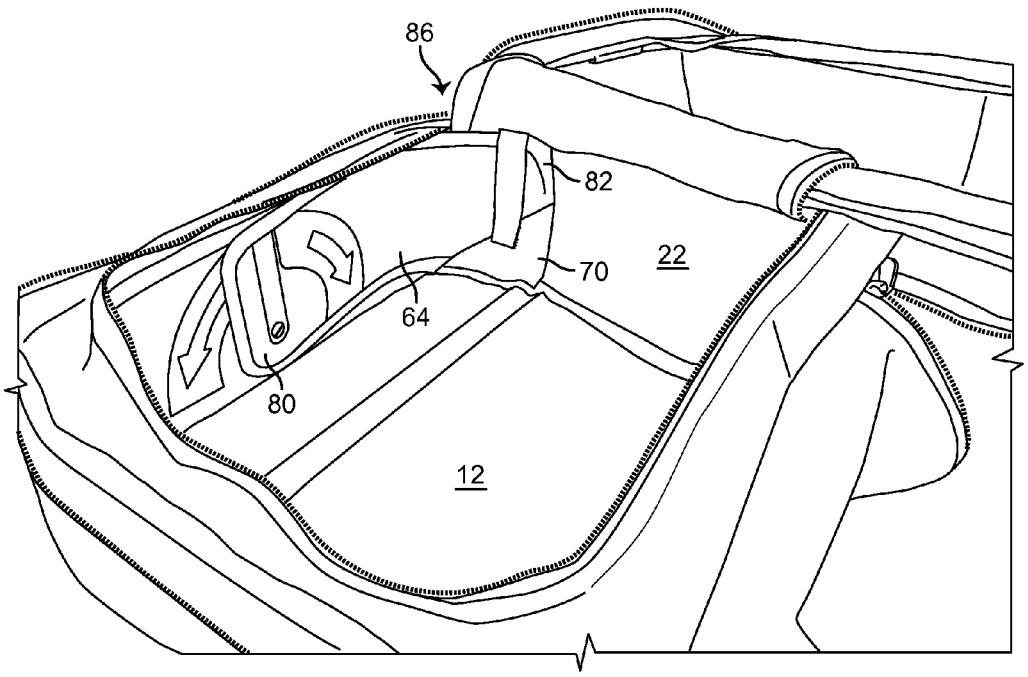

Referring particularly to FIGS. 4A-4B, wings 62-64 are shown in the reinforcing position, according to an exemplary embodiment. In the reinforcing position, left wing 62 reinforces a left corner 84 of front section 32 (i.e., the intersection of bottom surface 18 and left side surface 20) and maintains bottom surface 18 substantially perpendicular to both left side surface 20 and front surface 12. Similarly, right wing 64 reinforces a right corner 86 of front section 32 (i.e., the intersection of bottom surface 18 and right side surface 22) and maintains bottom surface 18 substantially perpendicular to both right side surface 22 and front surface 12. In the reinforcing position, long edge 88 is parallel to front surface 12 and short edge 90 is perpendicular to front surface 12.

As shown in FIG. 4B, when wings 62-64 are in the reinforcing position, right wing 64 bends around right corner 86 such that a first portion 80 of right wing 64 is substantially parallel to bottom surface 18 and a second portion 82 of right wing 64 is substantially parallel to right side surface 22. Similarly, left wing 62 bends around left corner 84 in the reinforcing position such that a first portion of left wing 62 is substantially parallel to bottom surface 18 and a second portion of left wing 62 is substantially parallel to left side surface 20. In some embodiments, each of wings 62-64 is bent by approximately 90° in the reinforcing position.

In some embodiments, collapsible luggage 10 includes a left pocket 68 attached to left side surface 20 and a right pocket 70 attached to right side surface 22. Left pocket 68 may be configured to receive a portion of left wing 62 when left wing 62 is in the reinforcing position. Similarly, right pocket 70 may be configured to receive a portion of right wing 64 when right wing 64 is in the reinforcing position. In some embodiments, collapsible luggage 10 includes a left fastener 72 configured to secure left wing 62 in the reinforcing position and a right fastener 74 configured to secure right wing 64 in the reinforcing position. In some embodiments, fasteners 72-74 are hook-and-loop fasteners (e.g., Velcro straps). In other embodiments, fasteners 72-74 may be snaps, buckles, clips, or any other suitable fastener.

Figure 5:
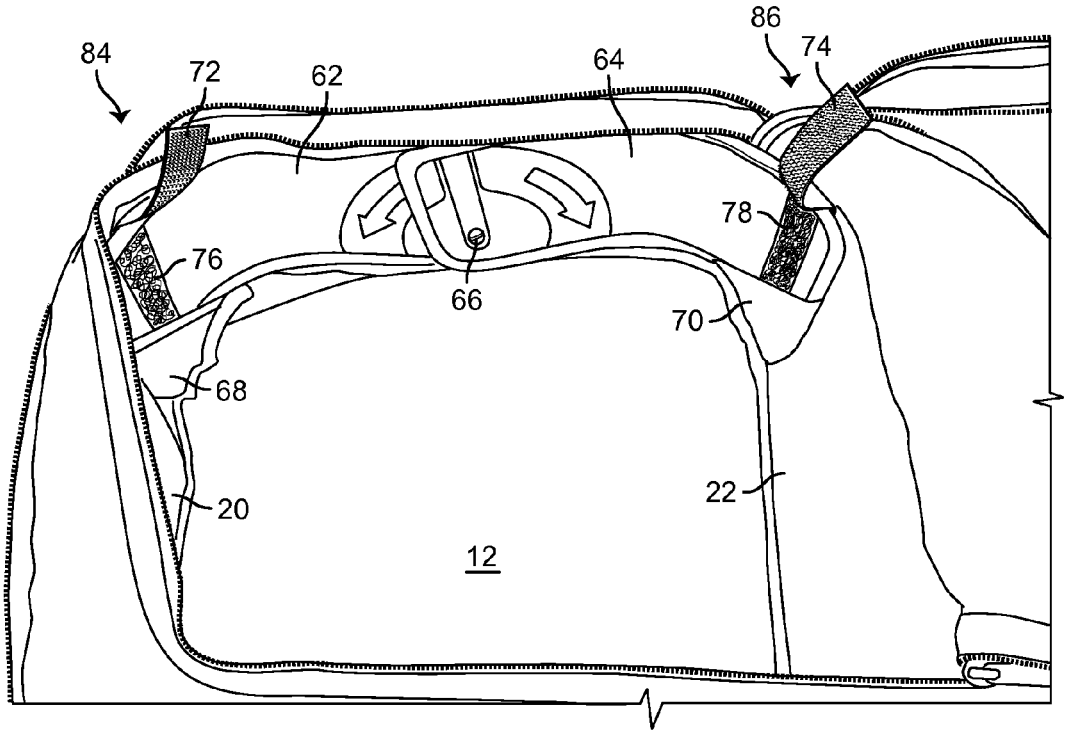
FIG. 5 is a drawing illustrating fasteners configured to hold the split wing assembly of FIGS. 4A-4B in the reinforcing position, according to an exemplary embodiment.

Referring now to FIG. 5, left fastener 72 may be configured to engage a hook-and-loop fastener patch 76 affixed to an inward-facing surface of left wing 62. Similarly, right fastener 74 may be configured to engage a hook-and-loop fastener patch 78 affixed to an inward-facing surface of right wing 64. Fasteners 72-74 may be applied to fastener patches 76-78 to secure wings 62-64 within pockets 68-70 in the reinforcing position. As shown in FIG. 5, fasteners 72-74 may be removed from fastener patches 76-78 to allow wings 62-64 to be removed from pockets 68-70 and moved toward the collapsing position.

Figure 6:
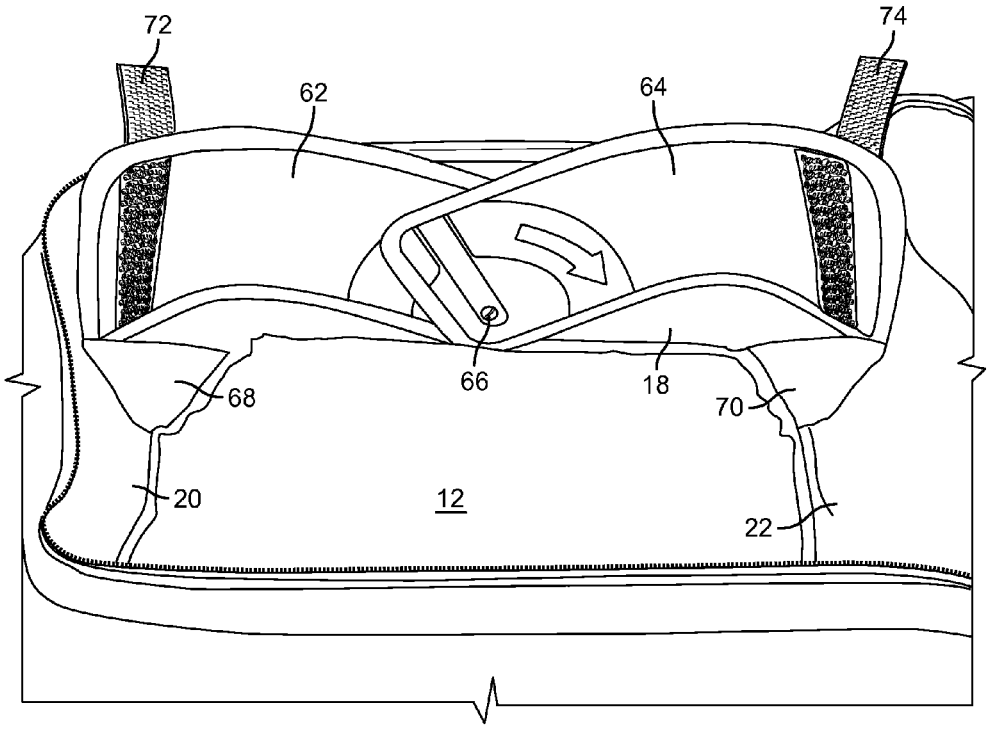
FIG. 6 is a drawing of a left wing and a right wing of the split wing assembly of FIGS. 4A-4B being removed from pockets configured to hold the left wing and the right wing in the reinforcing position, according to an exemplary embodiment.
Figure 7:
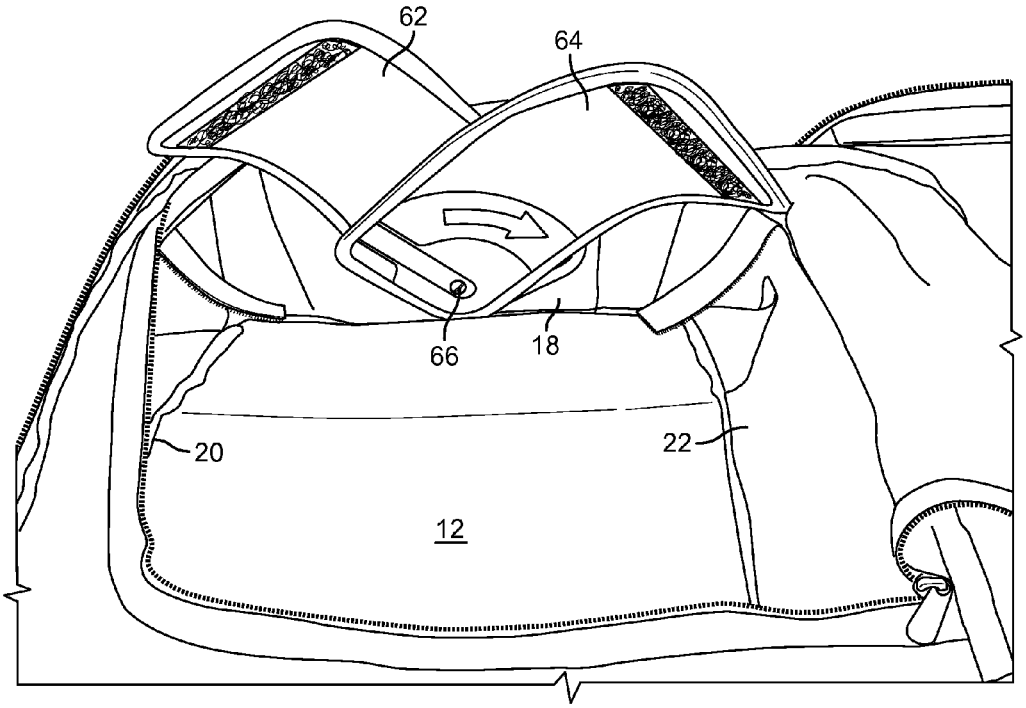
FIG. 7 is a drawing illustrating the split wing assembly of FIGS. 4A-4B rotating between the reinforcing position and a collapsing position in which the split wing assembly allows the collapsible luggage to collapse into the collapsed state, according to an exemplary embodiment.

Referring now to FIGS. 6-7, wings 62-64 can be removed from pockets 68-70 by rotating wings 62-64 about rivet 66. Rotating wings 62-64 about rivet 66 may cause wings 62-64 to move between the reinforcing position and the collapsing position. Wings 62-64 may rotate in opposite directions when moving from the reinforcing position toward the collapsing position. Wings 62-64 may also rotate in opposite directions when moving from the collapsing position toward the reinforcing position. In some embodiments, each of wings 62-64 includes a marking indicating the direction that the wing rotates when moving from the collapsing position into the reinforcing position.

In FIG. 7, wings 62-64 are shown in an intermediate position approximately halfway between the reinforcing position and the collapsing position. As wings 62-64 continue to rotate toward the collapsing position, left wing 62 moves closer to right side surface 22 and right wing 64 moves closer to left side surface 20. Additionally, wings 62-64 may lose their curvature as they continue to rotate such that wings 62-64 are no longer bent when they reach the collapsing position. In other embodiments, wings 62-64 lose their curvature when they are collapsed to be substantially coplanar with front surface 12 (as shown in FIG. 9).

Figure 8A:
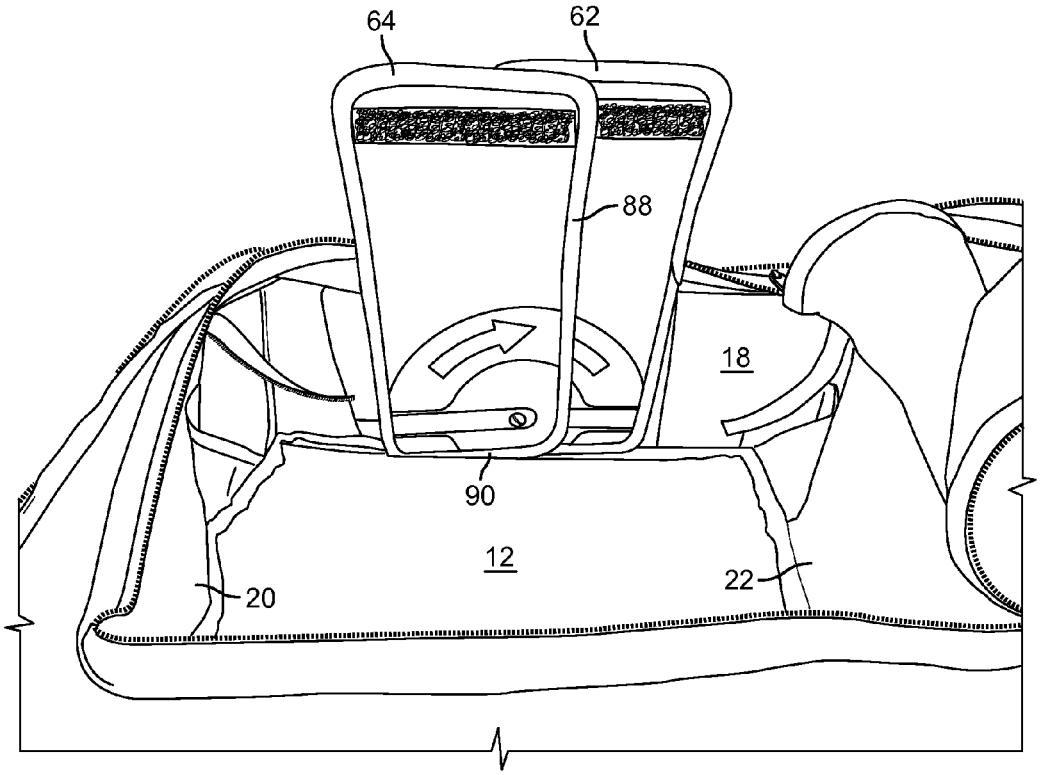
FIGS. 8A-8B are drawings illustrating the split wing assembly of FIGS. 4A-4B in the collapsing position, according to an exemplary embodiment.
Figure 8B:
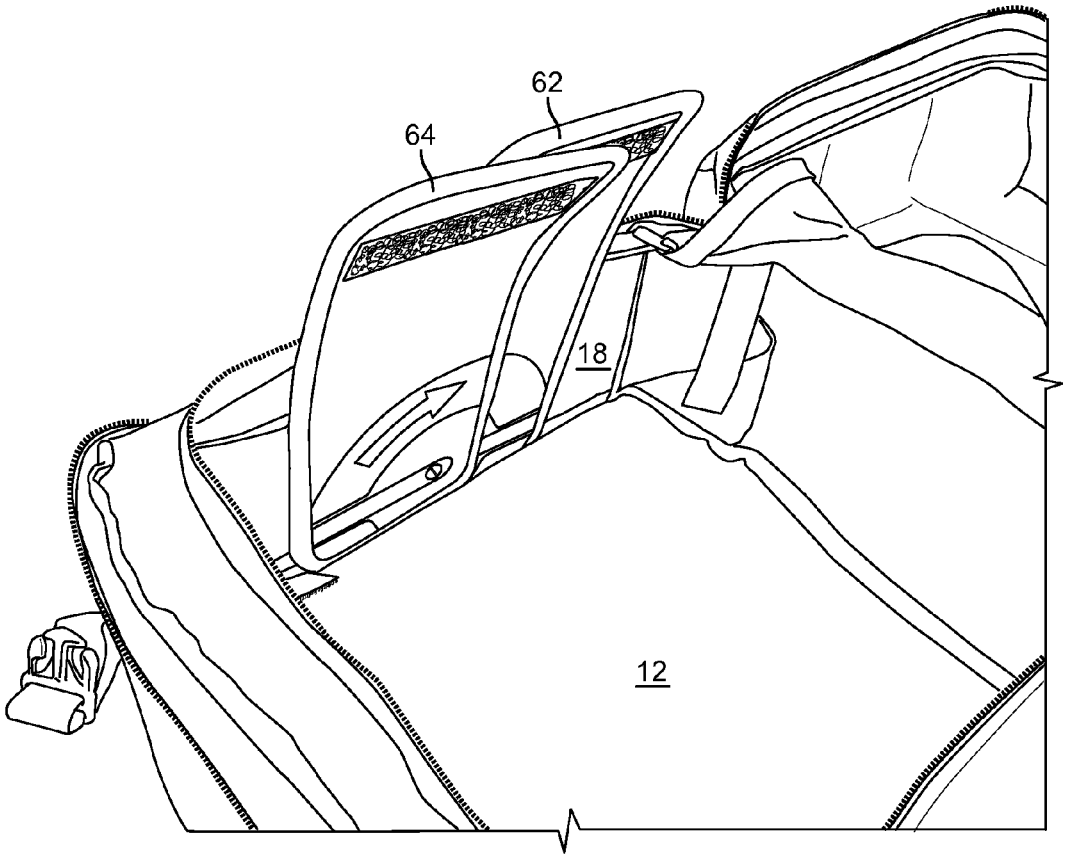

Referring now to FIGS. 8A-8B, wings 62-64 are shown in the collapsing position, according to an exemplary embodiment. In the collapsing position, both of wings 62-64 may be substantially planar sheets parallel to bottom surface 18. As shown in FIG. 8A, long edge 88 may be perpendicular to front surface 12 and short edge 90 may be parallel to front surface 12 when wings 62-64 are in the collapsing position. In some embodiments, wings 62-64 are no longer bent by 90°, but rather have minimal or no curvature in the collapsing position. In the collapsing position, wings 62-64 do not reinforce corners 84-86. Without the reinforcement provided by wings 62-64, left side surface 20, right side surface 22, and bottom surface 18 may collapse into a substantially coplanar arrangement with front surface 12.

Figure 9:
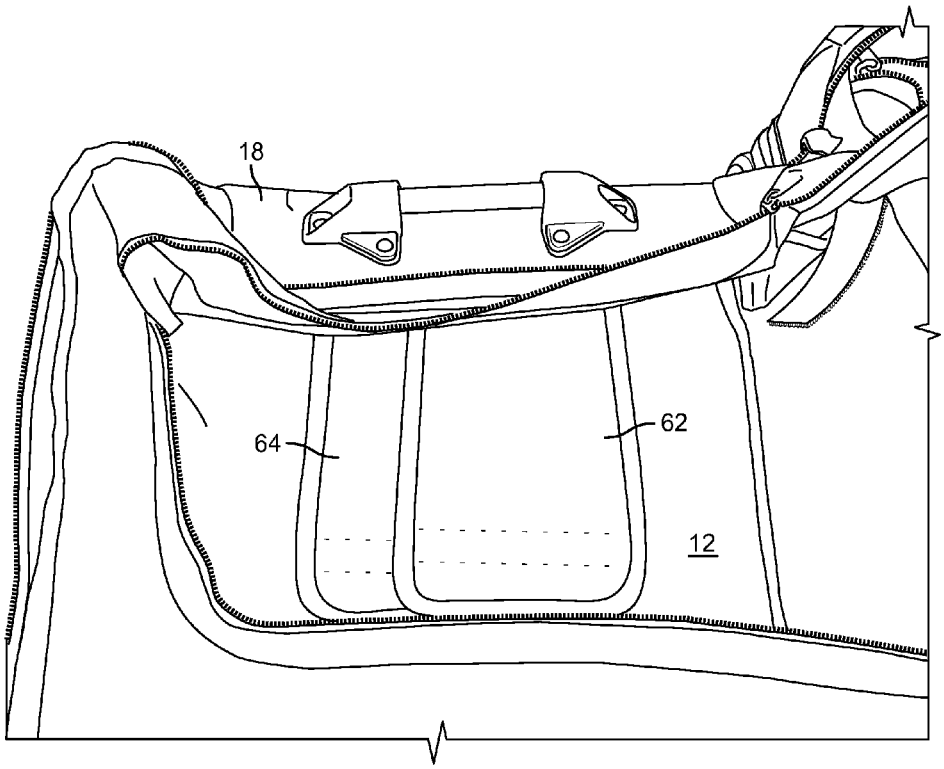
FIG. 9 is a drawing illustrating the collapsible luggage of FIG. 1 in a partially collapsed state in which a bottom surface of the collapsible luggage is substantially coplanar with a front surface of the collapsible luggage, according to an exemplary embodiment.
Figure 10:
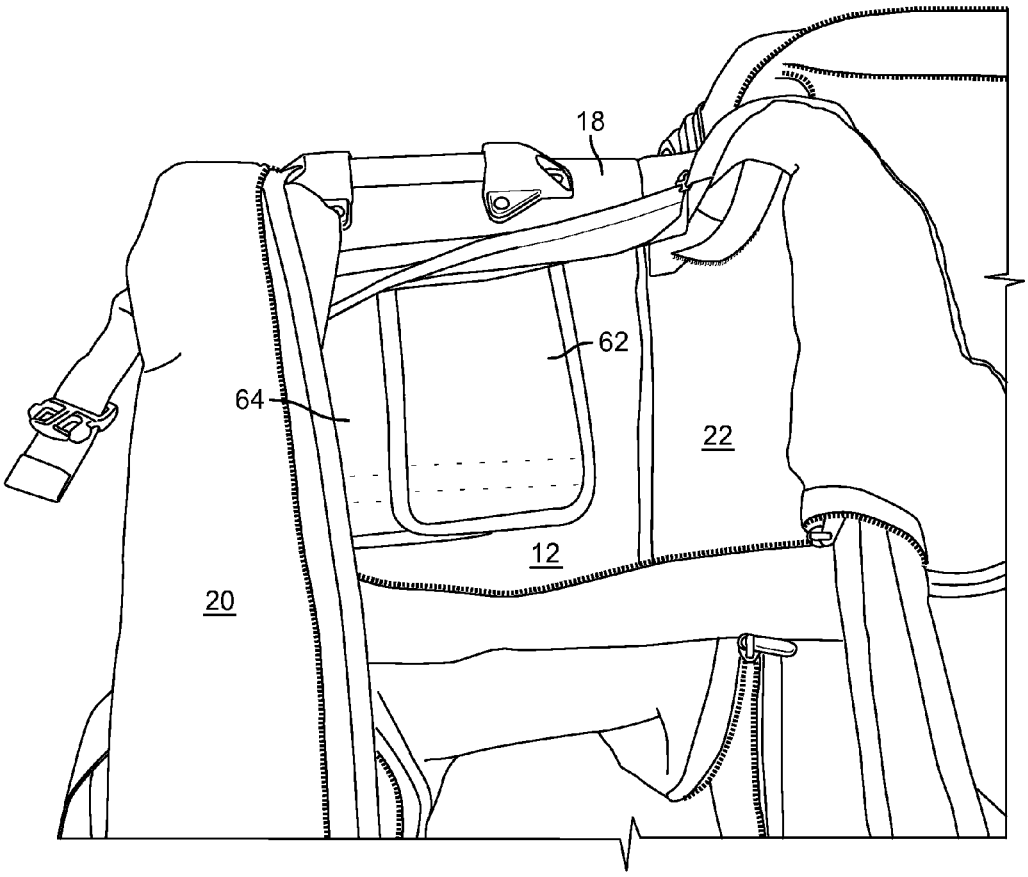
FIG. 10 is a drawing illustrating the collapsible luggage of FIG. 1 in another partially collapsed state in which the bottom surface and a side surface of the collapsible luggage are substantially coplanar with the front surface of the collapsible luggage, according to an exemplary embodiment.

Referring now to FIGS. 9-10, collapsible luggage 10 is shown collapsing into the collapsed state. Collapsible luggage 10 may collapse into the collapsed state once wings 62-64 have reached the collapsing position shown in FIGS. 8A-8B. In some embodiments, bottom surface 18 is substantially rigid and configured to rotate about the edge of intersection between bottom surface 18 and front surface 12. Bottom surface 18 may rotate into a position in which bottom surface 18 is parallel to front surface 12 and substantially coplanar with front surface 12, as shown in FIG. 9.

Similarly, left side surface 20 may be configured to rotate about the edge of intersection between left side surface 20 and front surface 12 to collapse into the substantially coplanar arrangement with front surface 12, as shown in FIG. 10. Right side surface 22 may be configured to rotate about the edge of intersection between right side surface 22 and front surface 12 to collapse into the substantially coplanar arrangement with front surface 12. Top surface 16 may be configured to rotate about the edge of intersection between top surface 16 and front surface 12 to collapse into the substantially coplanar arrangement with front surface 12. In other embodiments, one or more of top surface 16, bottom surface 18, left side surface 20, or right side surface 22 may bend, crease, buckle, crumple, or otherwise collapse such that front section 32 reduces in volume (e.g., flattens, compresses, etc.) when collapsing into the collapsed state.

After front section 32 has been collapsed, front section 32 may be rotated into the closed position and/or inserted into rear section 34, as shown in FIG. 2B. When collapsible luggage 10 is in the collapsed state, collapsible luggage 10 may occupy approximately half the volume relative to the expanded state. For example, the volume of collapsible luggage 10 in the collapsed state may be between 40% and 60% of the volume of collapsible luggage 10 in the expanded state.

Throughout this disclosure, split wing assembly 60 is shown and described as reinforcing the bottom corners of front section 32 in the reinforcing position. However, is contemplated that in various embodiments of the present invention, one or more additional split wing assemblies may be used to reinforce the top corners of front section 32 and/or the corners of rear section 34 in a similar manner. For example, the fixed corner supports 38 of rear section 34 may be replaced with a collapsible split wing assembly which enables rear section 34 to transform between an expanded and collapsed state, thereby further reducing the volume occupied by collapsible luggage 10 in the collapsed state.

The construction and arrangement of the collapsible luggage and components thereof as shown in the various exemplary embodiments are illustrative only. Although only a few implementations of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

Numerous specific details are described to provide a thorough understanding of the disclosure. However, in certain instances, well-known or conventional details are not described in order to avoid obscuring the description. References to "some embodiments," "one embodiment," "an exemplary embodiment," and/or "various embodiments" in the present disclosure can be, but not necessarily are, references to the same embodiment and such references mean at least one of the embodiments.

Alternative language and synonyms may be used for anyone or more of the terms discussed herein. No special significance should be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

The elements and assemblies may be constructed from any of a wide variety of materials that provide sufficient strength or durability, in any of a wide variety of colors, textures, and combinations. Further, elements shown as integrally formed may be constructed of multiple parts or elements.

As used herein, the word "exemplary" is used to mean serving as an example, instance or illustration. Any implementation or design described herein as "exemplary" is not necessarily to be construed as preferred or advantageous over other implementations or designs. Rather, use of the word exemplary is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary implementations without departing from the scope of the appended claims.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

As used herein, the terms "coupled," "connected," "attached," and similar terms mean the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

The background section is intended to provide a background or context to the invention recited in the claims. The description in the background section may include concepts that could be pursued, but are not necessarily ones that have been previously conceived or pursued. Therefore, unless otherwise indicated herein, what is described in the background section is not prior art to the description and claims in this application and is not admitted to be prior art by inclusion in the background section.

What is claimed is:

1. An article of collapsible luggage comprising:

a front surface comprising a left side edge, a right side edge, and a bottom edge connecting the left side edge to the right side edge;

a left side surface connected to the front surface along the left side edge;

a right side surface connected to the front surface along the right side edge;

a bottom surface connected to the front surface along the bottom edge and connecting the left side surface to the right side surface, wherein an intersection of the bottom surface and the left side surface defines a left corner and an intersection of the bottom surface and the right side surface defines a right corner;

a split wing assembly comprising a left wing and a right wing, both wings pivotally attached to the bottom surface and configured to rotate about an axis substantially perpendicular to the bottom surface between:

a reinforcing position in which the left wing reinforces the left corner and maintains the bottom surface substantially perpendicular to both the left side surface and the front surface, and the right wing reinforces the right corner and maintains the bottom surface substantially perpendicular to both the right side surface and the front surface, and a collapsing position in which the wings do not reinforce the corners, thereby allowing the left side surface, the right side surface, and the bottom surface to collapse into a substantially coplanar arrangement with the front surface; and a left fastener configured to secure the left wing in the reinforcing position and a right fastener configured to secure the right wing in the reinforcing position, wherein the left fastener and the right fastener are hook-and-loop fasteners comprising:

a hook-and-loop fastener patch affixed to an inward-facing surface of each wing; and a hook-and-loop fastener strap attached to each of the left surface and the right surface.

2. The collapsible luggage of claim 1, wherein the bottom surface is substantially rigid and configured to rotate about the bottom edge to collapse into the substantially coplanar arrangement with the front surface when the wings are in the collapsing position.

3. The collapsible luggage of claim 1, wherein:

each of the wings is a substantially rectangular sheet having a long edge and a short edge perpendicular to the long edge;

the long edge of each wing is parallel to the front surface when the wings are in the reinforcing position; and the short edge of each wing is parallel to the front surface when the wings are in the collapsing position.

4. The collapsible luggage of claim 1, wherein:

the left wing and the right wing are pivotally attached to the bottom surface by a fastener which passes through both wings and the bottom surface; and both wings rotate about the same axis coaxial with the rivet.

5. The collapsible luggage of claim 4, wherein:

each of the wings is a substantially rectangular sheet having a long edge and a short edge perpendicular to the long edge; and the fastener passes through a point in each wing approximately equidistant from both the long edge and the short edge.

6. The collapsible luggage of claim 1, wherein the left wing and the right wing rotate in opposite directions when moving from the collapsing position into the reinforcing position.

7. The collapsible luggage of claim 6, wherein each wing comprises a marking indicating the direction that the wing rotates when moving from the collapsing position into the reinforcing position.

8. The collapsible luggage of claim 1, wherein the left wing and the right wing are configured to bend between:

the collapsing position in which both wings are planar sheets substantially parallel to the bottom surface; and the reinforcing position in which both wings are bent by approximately 90° such that a first portion of each wing is substantially parallel to the bottom surface and a second portion of each wing is substantially parallel to the left and right side surfaces.

9. The collapsible luggage of claim 1, wherein:

the left wing is configured to bend around the left corner when rotated into the reinforcing position such that a first portion of the left wing is substantially parallel with the bottom surface and a second portion of the left wing is substantially parallel with the left surface; and the right wing is configured to bend around the right corner when rotated into the reinforcing position such that a first portion of the right wing is substantially parallel with the bottom surface and a second portion of the right wing is substantially parallel with the right surface.

10. The collapsible luggage of claim 1, further comprising:

a left pocket attached to the left side surface and configured to receive a portion of the left wing when the left wing is rotated into the reinforcing position; and a right pocket attached to the right side surface and configured to receive a portion of the right wing when the right wing is rotated into the reinforcing position.

11. An article of collapsible luggage comprising:

a rear section comprising a rear surface, a plurality of rear perimeter walls forming a closed perimeter around the rear surface, and a plurality of fixed support members reinforcing corners of the rear section and maintaining the plurality of rear perimeter walls substantially perpendicular to the rear surface; and a front section attached to the rear section, the front section comprising a front surface, a plurality of front perimeter walls forming a closed perimeter around the front surface, and a split wing assembly having a left wing and a right wing, both wings pivotally attached the front perimeter walls and configured to rotate between:

a reinforcing position in which the wings reinforce corners of the front section and maintain the plurality of front perimeter walls substantially perpendicular to the front surface, and a collapsing position in which the wings do not reinforce the corners of the front section, thereby allowing the plurality of front perimeter walls to collapse into a substantially coplanar arrangement with the front surface;

wherein the front perimeter walls comprise a bottom wall, the left wing and the right wing are pivotally attached to the bottom wall by a fastener which passes through both wings and the bottom wall, and both wings rotate about a shared axis coaxial with the fastener;

wherein each of the wings is a substantially rectangular sheet having a long edge and a short edge perpendicular to the long edge, wherein the fastener passes through a point in each wing approximately equidistant from both the long edge and the short edge.

12. The collapsible luggage of claim 11, wherein the front section is configured to fit within the rear section when the front perimeter walls collapse into the substantially coplanar arrangement with the front surface.

13. The collapsible luggage of claim 11, wherein:

the front perimeter walls comprise a bottom wall, a left side wall, and a right side wall; and the left wing and the right wing are configured to bend between:

the collapsing position in which both wings are planar sheets substantially parallel to the bottom wall; and the reinforcing position in which both wings are bent by approximately 90° such that a first portion of each wing is substantially parallel to the bottom wall and a second portion of each wing is substantially parallel to the left and right side walls.

14. The collapsible luggage of claim 11, wherein:

the left wing and the right wing rotate in opposite directions when moving from the collapsing position into the reinforcing position; and each wing comprises a marking indicating the direction that the wing rotates when moving from the collapsing position into the reinforcing position.

15. The collapsible luggage of claim 11, further comprising:

a left pocket attached to the plurality of front perimeter walls and configured to receive a portion of the left wing when the left wing is rotated into the reinforcing position; and a right pocket attached to the plurality of front perimeter walls and configured to receive a portion of the right wing when the right wing is rotated into the reinforcing position.

16. The collapsible luggage of claim 11, further comprising:

a left fastener configured to secure the left wing in the reinforcing position; and a right fastener configured to secure the right wing in the reinforcing position.

* * * * *